US006398120B1

(12) United States Patent
Klein

(10) Patent No.: US 6,398,120 B1
(45) Date of Patent: Jun. 4, 2002

(54) MODEL RAILROAD ELECTRIC TUBULAR SNAP-TOGETHER TRACK

(76) Inventor: Maury D. Klein, 510 Quinn Ct., Chapel Hill, NC (US) 27516

( * ) Notice: Subject to any disclaimer, the term of this patent is extended or adjusted under 35 U.S.C. 154(b) by 0 days.

(21) Appl. No.: 09/448,284

(22) Filed: Nov. 24, 1999

Related U.S. Application Data

(60) Provisional application No. 60/160,881, filed on Oct. 22, 1999.

(51) Int. Cl.[7] ..... E01B 23/00
(52) U.S. Cl. ..... 238/10 B; 104/DIG. 1
(58) Field of Search ..... 238/10 A, 10 E, 238/10 B, 10 R; 104/DIG. 1

(56) References Cited

U.S. PATENT DOCUMENTS

| | | | | |
|---|---|---|---|---|
| 2,265,965 A | * | 12/1941 | Frisbie | 238/10 |
| 2,673,689 A | * | 3/1954 | Bonanno | 238/10 |
| 4,223,834 A | | 9/1980 | Fechter | |
| 4,225,081 A | | 9/1980 | Ikegame | |
| 4,709,856 A | | 12/1987 | Röther et al. | |
| 4,771,943 A | | 9/1988 | Cooney et al. | |
| 4,841,104 A | * | 6/1989 | Adell | 191/29 R |
| 4,898,326 A | | 2/1990 | Edwards et al. | |
| 4,953,785 A | | 9/1990 | Keska | |
| 4,955,537 A | | 9/1990 | Bratovz | |
| 4,993,631 A | | 2/1991 | Niehoff | |
| 5,139,198 A | | 8/1992 | Niehoff | |
| 5,503,330 A | | 4/1996 | Riley | |
| 5,529,241 A | | 6/1996 | Roder | |
| 5,690,278 A | | 11/1997 | Grubb | |
| 5,752,678 A | | 5/1998 | Riley | |
| 6,019,289 A | * | 2/2000 | Sung | 238/10 E |

* cited by examiner

*Primary Examiner*—S. Joseph Morano
*Assistant Examiner*—Robert J. McCarry, Jr.
(74) *Attorney, Agent, or Firm*—Venable; John P. Shannon; Chad C. Anderson

(57) ABSTRACT

A model toy train track assembly provides separate electrical and mechanical locking or snap-together connections. A molded base of each track assembly has a protruding U-shaped feature on each end that physically joins to track assemblies or sections when pressed into a complementary receiving slot. To provide a reliable electrical connection, metal connectors corresponding to each of the rails lock into receiving connector slots of the adjoining track section. Alignment ribs on opposite sides of each rail ensure straight and accurate alignment of the rails. To prevent slipping of the rails, each rail is staked into the molded base. The rails are tubular and sized and positioned so as to provide compatibility with conventional two-rail or three-rail tubular tracks of similar gauge.

18 Claims, 5 Drawing Sheets

MODEL RAILROAD ELECTRIC TUBULAR SNAP-TOGETHER TRACK

This application claims the benefit of U.S. Provisional Application No. 60/160,881, filed Oct. 22, 1999.

BACKGROUND OF THE INVENTION

As is often the case, smaller, less obvious items are more crucial than the more austere and more eye-catching features. The importance of track to the model toy railroad industry can not be overemphasized; a train set can be beautifully crafted and engineered, but without a reliable, well-constructed track to run it on, the whole objective is defeated. The crucial factor in track layout and operation is continuous and constant mechanical and electrical connections without which the toy train will cease running or may derail. This is why track itself is a main focus of and is critical to model railroadry and why so much time and research are factored into the designs as well as the constant striving for improvements.

For a number of years, the common solution to maintaining this critical connection was only through mechanical means. In several inventions, the electrical current is maintained solely through direct rail to rail contact; the purpose of the mechanical invention, then, is to devise a secure contact or touching of the track rails themselves. However, in each case, if there is a separation of the mechanical features due to causes such as vibrations from the train running on the track or weakening of parts with age or other various factors, the electrical current is lost as well.

DESCRIPTION OF PRIOR ART

Traditionally, the basic model railroad track has been designed and produced with tubular rails formed from long, thin strips of tin sheet metal which are roll formed, a process of bending and shaping, to simulate the appearance of actual rails. This method was used not only for aesthetic reasons, but also provided the actual physical and electrical connections of the train layout. Although not the main focus of either U.S. Pat. Nos. 4,771,943 or 5,529,241, this type of tubular rail can be identified by examining these two patents. A common solution for tubular rail connection, if no other mechanical means of maintaining rail contact existed, was inserting, into the hollow rails, a rail connection, also known as a track pin, to connect two adjoining rails. A key problem re-occurring with inventions that solely rely on utilizing thin sheet metal to maintain connection is that sheet metal easily bends out of the originally formed shape and, thus, can lose its secure, close fit.

Aside from the common and traditional use of rail connectors, one approach to the problem of maintaining constant and continuous connection has been to attach an auxiliary and augmenting part to the track assembly itself. The thin sheet metal joints in U.S. Pat. No. 4,225,081, which connect directly onto the rails, provide additional connection but have the same tendency as other sheet metal products to bend out of the original shape and to lose the close contact as the rails are wiggled in and out.

U.S. Pat. No. 4,223,843 includes an elongated U-shaped sheet metal clamp to join the track sections. The flat, elongated section of the clamp lies beneath each rail section of two adjoining track sections, while the U-shaped clamp parts extend upwards between the crossties to hold the rails. The limited design of the clamp will only allow for use with track section of a particular base design and with particular crosstie spacing.

U.S. Pat. Nos. 4,993,631 and 5,139,198 by the same inventor, has a unique design of a separate solid figure-eight shaped connection element which fits into recesses formed into the underside of the solid ballast-type track bed body. Although providing both electrical and mechanical connections, this attachable connecting element presents a more complicated means of track connection than typical solutions in the model toy train industry.

A different type of approach evolved, involving only mechanical connections, by introducing various protruding and receiving elements formed as part of the molded plastic track bed base. However, electrical contact was still solely dependent upon a close contact of the rails themselves, as no locking feature of the rails or additional electrical connectors were incorporated into the designs. If the mechanical connections loosen or separate, a gap between the rails will terminate the electrical current required for train operation. An example of this approach, U.S. Pat. No. 4,953,785 has, as part of the molded base, a series of interlocking protruding tongue elements and receiving slot elements to physically attach like track sections.

In U.S. Pat. No. 4,955,537, a separate lattice-like structure attaches to the underside of the molded track bed; it is this addition to the track bed which has a protruding two-prong fork shape element which locks into a complementary receiving slot. U.S. Pat. No. 5,690,278 has a somewhat more unique laterally offset track bed base with extending and recessed portions which result in a minimum of two locking positions of identical adjacent track sections.

A third approach has been to combine both of these two methods mentioned above by incorporating a design which has the sheet metal joint, as already discussed as U.S. Pat. No. 4,225,081, and a track bed base connection consisting of a protruding tongue-type element and a receiving slot-type element. U.S. Pat. No. 4,898,356 is such an invention which incorporates both a sheet metal joint connecting the rails and a rigid plastic tongue and socket concept connecting the base.

Likewise, U.S. Pat. Nos. 5,503,330, and 5,752,678 by the same inventor, utilizes the metallic joint on the rails as well as an open-ended, hook-like projection that bends and secures itself into a receiving slot. Unfortunately, with all of these approaches, as the tracks are connected and re-connected, the track sections have a tendency to fit together less securely over time, thereby allowing gaps between the rails, which result in loss of electrical connection and current.

In most recent years, in the field of model railroadry, a transition has been made towards what is frequently known as "snap-together" track, which has a plastic base, either solid or a crosstie lattice, that joins track sections together to provide the physical means of connection, while a separate system of metal connectors provide the electrical connection required for a continuous electrical current throughout the system.

A track assembly with both mechanical and electrical connection systems is seen in U.S. Pat. No. 4,709,856. In this invention, as part of the design, the locking elements consist of one which is upwardly open and the another element which consists of two parallel springs with a recess between said springs. The design has been incorporated specifically into the manufacture of the smaller type gauge track having a ballast-type track bed base and solid rails and can only be used in conjunction with identical track sections.

SUMMARY OF THE INVENTION

The present invention is the first to incorporate both the traditional tubular rails and the recent snap-together type track, which incorporates separate, yet complementary, electrical and mechanical connection systems into one design which can be used with not only identical track sections but also with any manufacturer's tubular track of the same gauge. The features and positioning of the mechanical and electrical connectors allow for use of these track sections with the common, traditional tubular track sections that have been widely manufactured. In addition, although a major irritation to track manufacturers, the problem of rails sliding and slipping from position has been addressed infrequently in previous inventions. Improvements in this area are part of the present invention as well.

The present invention has at least the following objectives: to provide secure and reliable mechanical and electrical track assemblies, to create a unique dual compatibility system of both tubular and snap-together track, to prevent lengthwise sliding of rails, and to prevent lateral sliding of the rails.

The present invention provides a model toy train track assembly which addresses improvements to four areas of concern in the model railroad industry: mechanical and electrical connection maintenance, compatibility with other manufactured train track, tubular rail alignment, and rail slideage. A solution to maintaining connection has been provided by two separate mechanical and electrical systems. The tubular quality of the rails allows for dual use with an O gauge tubular track, regardless of the manufacturer. Two alignment ribs positioned against each rail on the end crosstie ensure a straight and even alignment of juxtaposed rails from two joining track sections. To prevent slipping and sliding of the rails on the track bed, each rail is staked into the track bed base.

In accordance with the present invention, a model toy train track assembly comprises three tubular rails attached to a simulated crosstie molded track bed. Each rail is formed from a single narrow, thin sheet of metal bent and shaped to the common shape of a railroad track rail. The rails run parallel to each other along the length of the track bed. The track bed itself is a one-piece lattice-type structure that, upon attachment of the rails, resembles wood crossties when viewed from the top and sides to create a traditional, realistic railroad track.

The elements of the physical or mechanical connection system, which join track sections together, are incorporated into the basic molded plastic structure of the track bed base. The structure at the end of each piece of track is duplicated at the other end of the same track piece, the structure comprising a flexible, hollow U-shaped protruding tongue projecting outward from and in the same direction as the leftmost rail when viewed from the bottom side. The middle rail does not have any features assisting in the mechanical connection, whereas the rightmost rail has a formed receiving slot element to lock in the protruding U-shaped tongue element coinciding with the next adjoining track section. In addition, immediately between the rightmost rail and the end crosstie is a rectangular ledge with slightly raised edges to guide the rail from the adjoining section into place.

The main element of the electrical connection system is comprised of a thin metal connector. The connector is located on the underneath side of the plastic track bed base, situated flush with the end sections of that base, corresponding directly to a rail. Thus, each end section of track has three connectors, one for each rail, with a total of six of these identical connectors per track piece. The connectors are physically attached to the track assembly by two means. First, circular holes cut into the sheet metal allow the connector to snap down onto two round projections which are part of the molded track bed base. Second, two side strips of sheet metal that span out from the main section of sheet metal are wrapped up and around each section of track bed below the rails, thereby not only providing attachment to the track bed but also creating and maintaining contact of the connectors with the rails.

While these two features provide connector-to-rail contact, the contact between electrical connectors of two adjoining track sections is realized by complementary protruding and receiving elements of the connectors themselves. A rectangular plastic divider protruding up through the middle of the outwardmost end of the electrical connector from the track bed base divides the outermost, attaching end of the connector into two sections. Looking from the bottom perspective of a track section, the rightmost side of the electrical connector implements two protruding strips of metal which fold together to form a closed extension. Each of these extensions inserts into a complementary receiving area of the opposing adjoining connector. A well-secured fit of the protruding extension is accomplished by 1) the presence of the plastic divider, and by 2) the side wall of the mechanical locking elements and the second of the receiving metal connectors that bends up to form an edge along this side wall.

A track section is designed to join together agreeably with identical track sections of the same manufacturer. As a result, whenever a new design of track is introduced, a hobbyist or user of a toy train setup must purchase enough of the new type of track to complete the desired layout. This particular invention introduces a track system whereby the track pieces can be connected not only with identical track sections but also with any tubular O gauge track from any manufacturer which establishes its mechanical and electrical connections through track pins that insert into the tubular rails. The tubular rail and track pin combination is a common and popular method of rail connection. The tubular rail feature of the present invention allows instant and universal compatibility of tubular rail track sections which benefits users and hobbyists who already own tubular track. Instead of requiring the model train operator to purchase an entire new track system, often at great expense, these track sections can supplement and augment an operator's existing collection of track pieces.

In addition, to enhance the benefit of the tubular rails, alignment ribs or guides have been added to maximize alignment of the rails at the critical point of contact with adjoining rails. Situated on the top side of each of the two end crossties of the track bed are two alignment ribs per rail which rise up from the plastic molded base and press against the rail to prevent bending or shifting of the rails. The plastic alignment ribs come up at right angles next to the lower straight sections of the metal rails. Although, these are not connected to the rails, they prevent lateral movement of the rails. Since the alignment ribs are located in close proximity to an adjacent joining track, a uniform alignment of the two rail sections is accomplished.

This particular track invention addresses another problem common to model railroadry, which is the sliding and slipping of rails on the track bed. The present improvement is to stake a small area of the lower section of the rail, which lies flat against the track bed, into a hole implemented into the design of the molded track bed base. The force of the staking and the bendability of the sheet metal provides a secure attachment which then prevents lateral and lengthwise movement of the rails. For each track section, this staking is implemented at two points for each rail, for example, at the fourth crosstie from each end of a track section. In order to hold the rails more tightly and prevent lateral movement of the rails, brackets simulating rail spikes are provided on some of the crossties. A ridge on the underside of each bracket holds the rail down tightly against the tie.

DETAILED DESCRIPTION OF PREFERRED EMBODIMENTS

Figure 5:
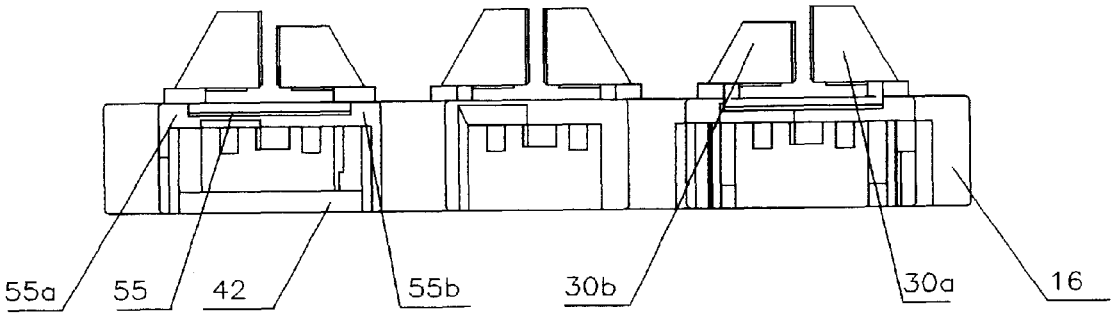
FIG. 5 is an end view of the track section of FIG. 3 with the rails.
Figure 6:
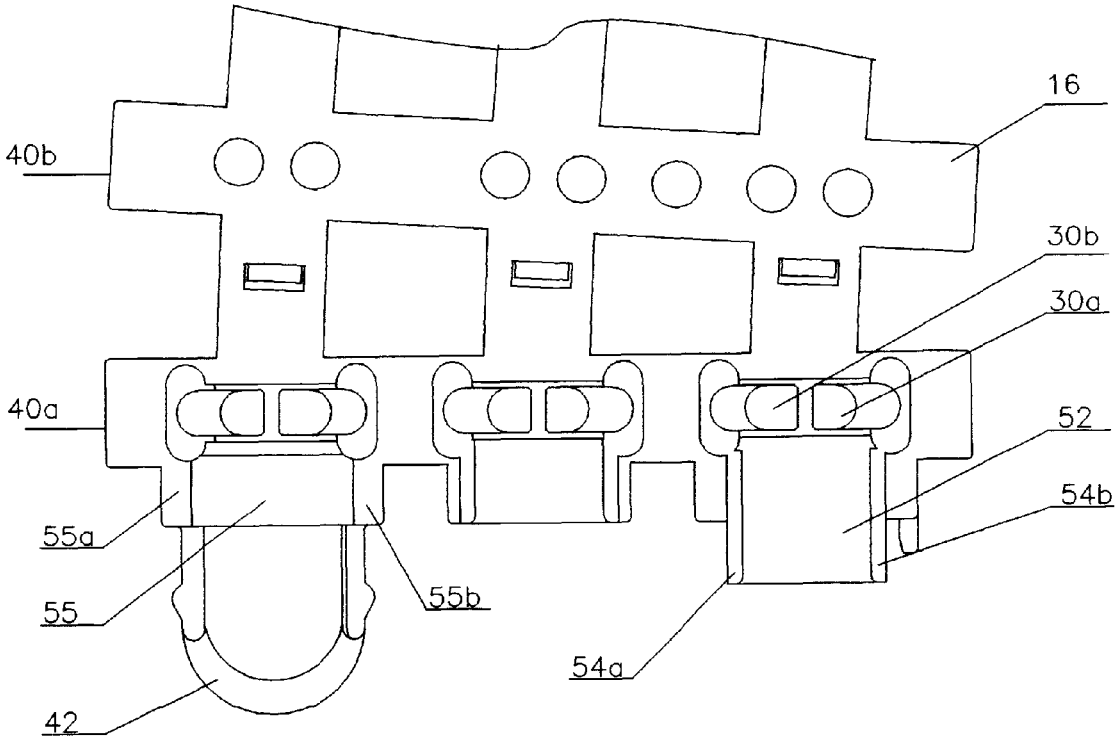
FIG. 6 is a partial top plan view of the track section of FIG. 3 with the rails removed.
Figure 7:
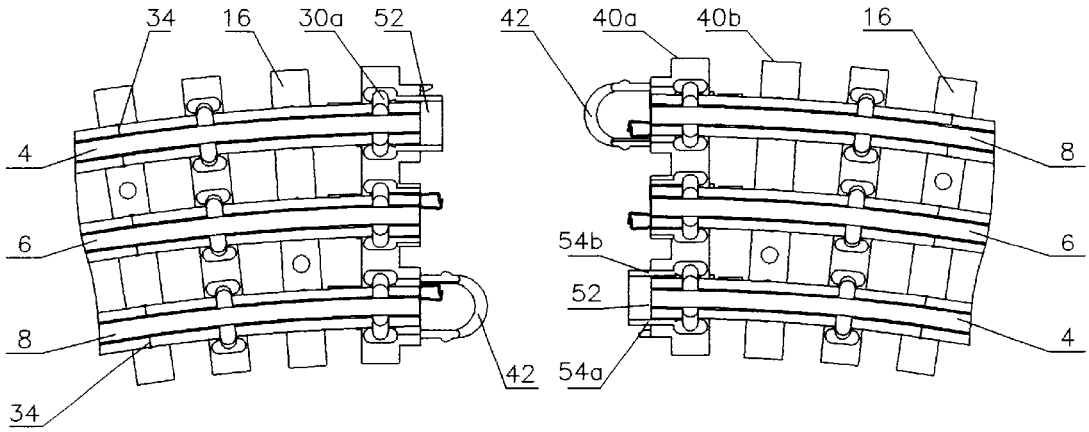
FIG. 7 is a partial plan view of two end sections of track in alignment with one another but unjoined.
Figure 8:
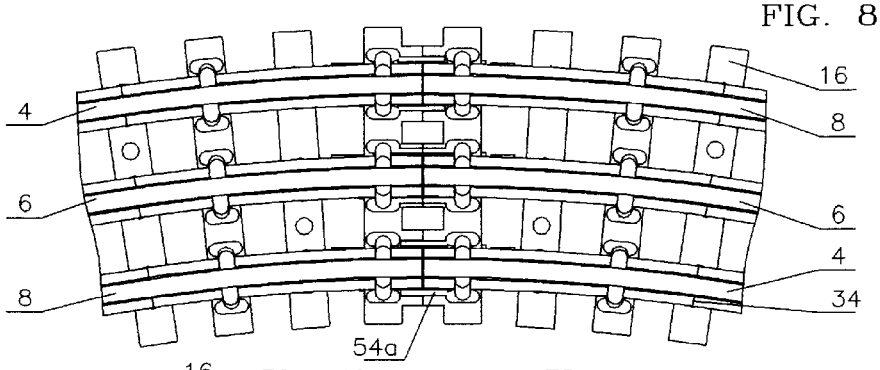
FIG. 8 is a partial bottom plan view of the two track sections of FIG. 7 joined together.
Figure 9:
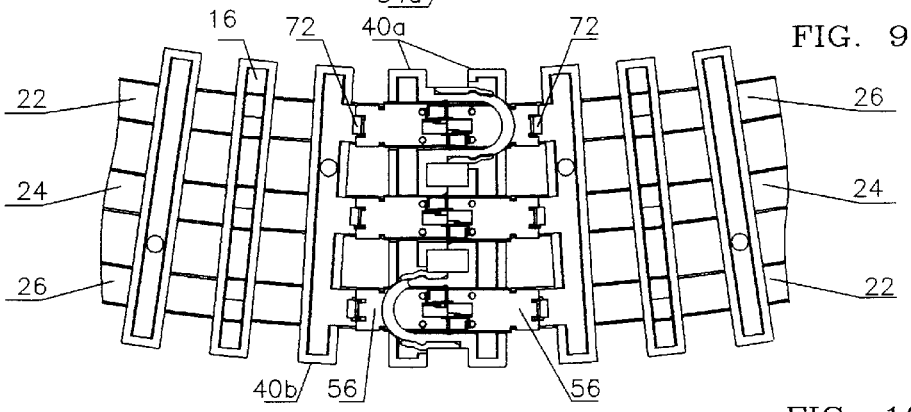
FIG. 9 is a bottom plan view of the track sections of FIG. 8.
Figure 10:
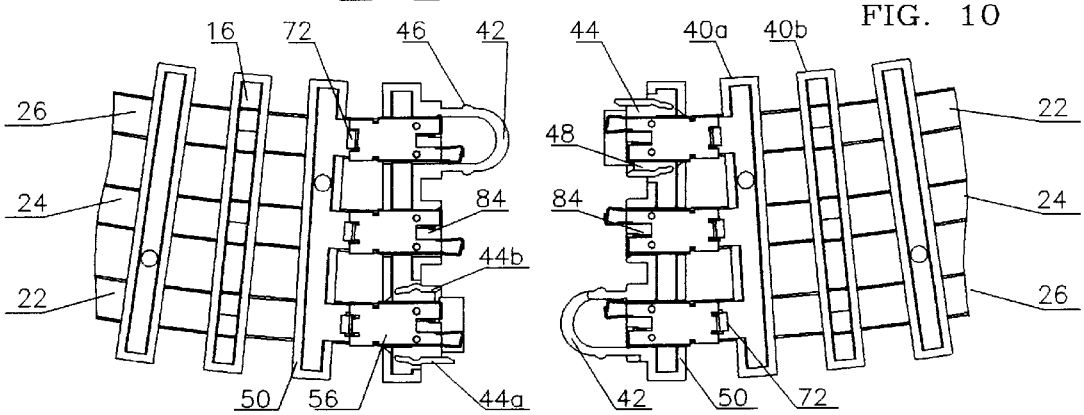
FIG. 10 is a bottom plan view of the track sections of FIG. 7.
Figure 11:
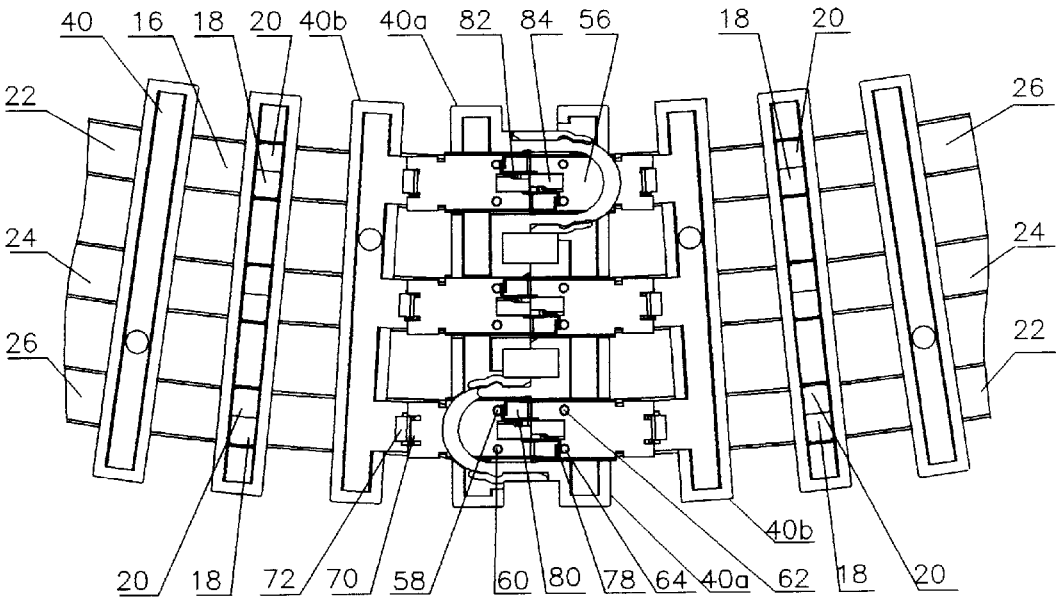
FIG. 11 is an enlarged partial bottom plan view of the track sections of FIG. 9 emphasizing the mechanical and electrical connection elements.
Figure 12:
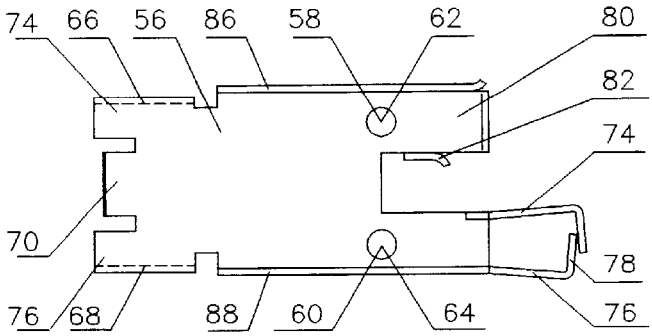
FIG. 12 is an enlarged bottom plan view of one of the electrical connections of one of the track sections of FIG. 10.

As can be seen from FIGS. 1–4, each model railroad electrical toy train track assembly, which is designated generally by the reference numeral 2, comprises three rails 4, 6, 8, each formed from one long thin piece of electrically conductive sheet metal through a process of bending and shaping known as roll forming, so that the middle of the narrowest section of each sheet creates a round hollow crown 10 that defines a tunnel extending the length of each sheet. From that point the portions of each rail on both sides of the crown 10 extend straight down towards a bed base 16, and the ends 18, 20 bend outward and lie flat with lengthwise portions of the molded plastic base 16. The molded base 16 has three such lengthwise portions 22, 24, 26, each corresponding to one of the three rails 4, 6, 8. To attach the rails 4, 6, 8 to the track bed base 16, the rails 4, 6, 8 are slid along parallel to the lengthwise base portions 22, 24, 26 through gaps in plastic rail spikes 28 and alignment ribs 30*a*, 30*b* that are part of the molded track bed base 16 until the rails and base are flush at each end. Referring to FIGS. 5 and 6, the alignment ribs 30*a*, 30*b* prevent lateral movement and bending of the rails 4, 6, 8, and the location of the alignment ribs on the two endmost crossties 40*a*, 40*b* provide rail alignment where it is most needed—in close proximity to the corresponding rail of an adjoining track section. By staking, small areas 34 of the flat thin sheet metal of the laterally outward ends 18, 20 of the tubular rails are pressed or staked into depressions 36 formed in the molded track bed base 16. This restrains the rails 4, 6, 8 from sliding freely through the rail spikes 28 and the alignment ribs 30*a*, 30*b*.

Figure 1:
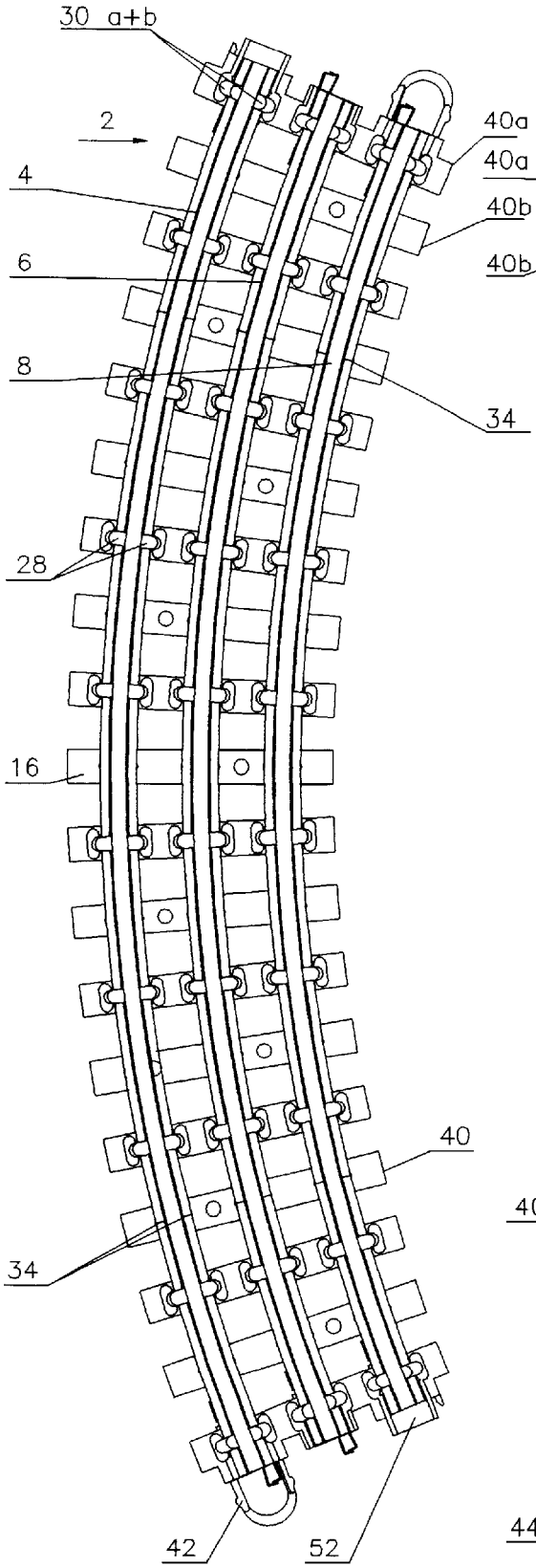
FIG. 1 a top plan view of one section of electric model railroad toy train track according to the invention.
Figure 2:
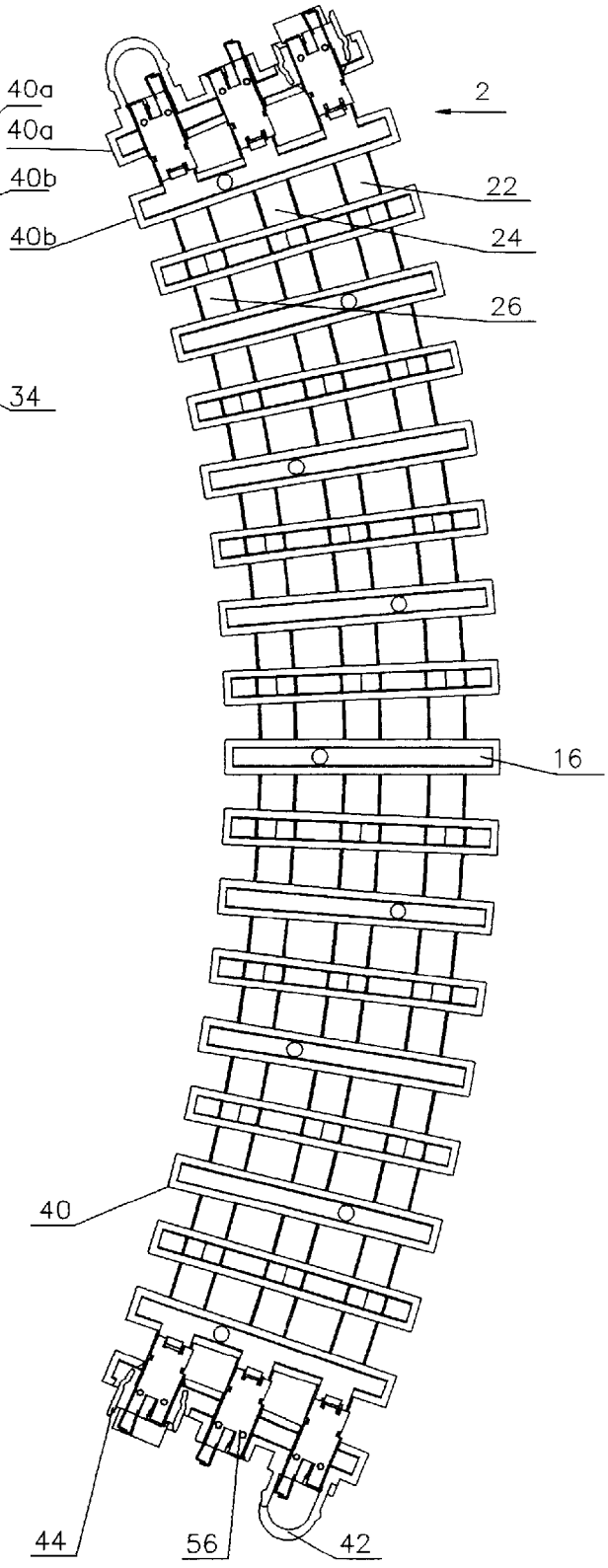
FIG. 2 is a bottom plan view of the track section of FIG. 1.
Figure 3:
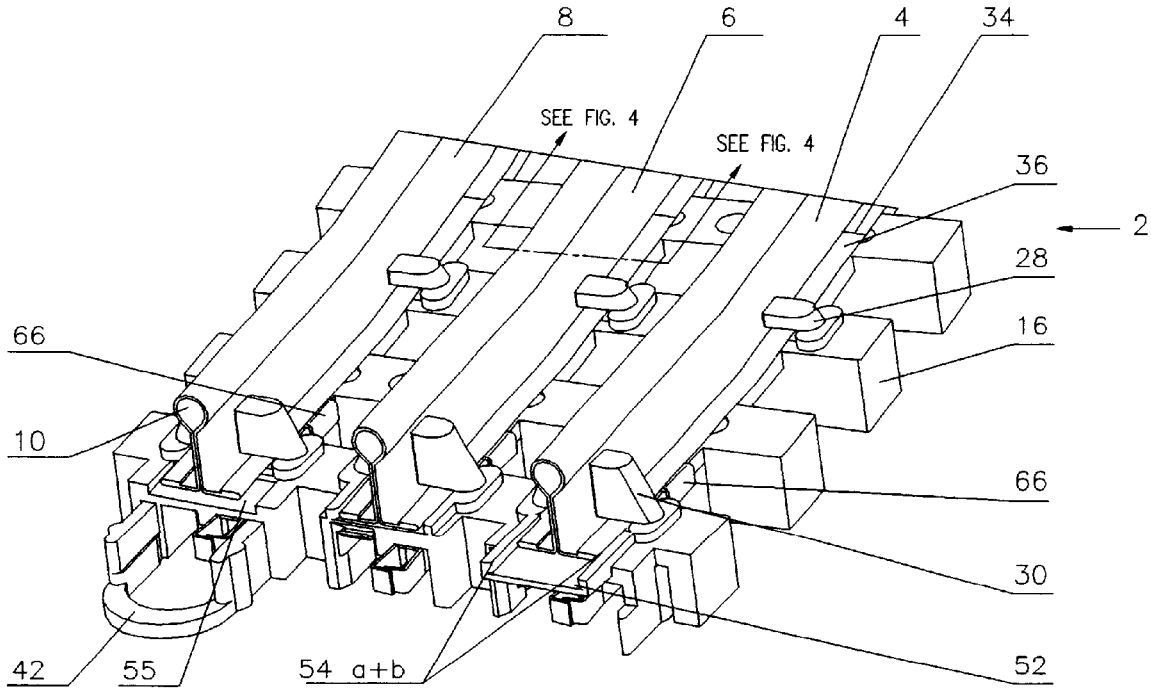
FIG. 3 is an enlarged partial perspective top view of the track section of FIG. 1, emphasizing the tubular rails, the alignment ribs, and the staked area of the rails.
Figure 4:
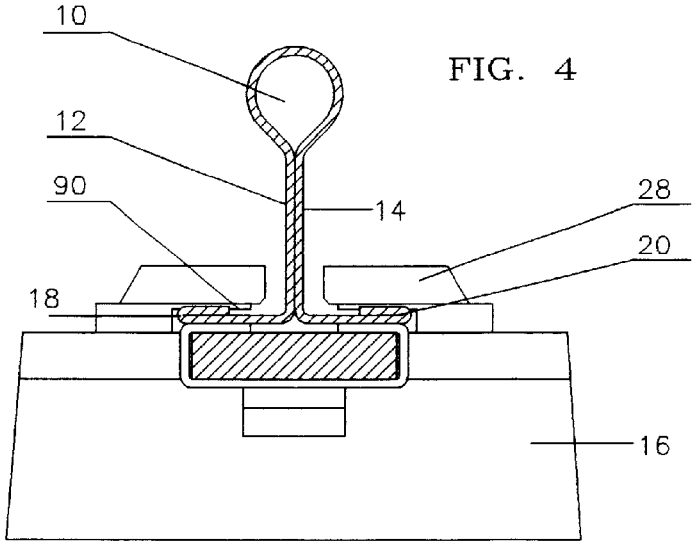
FIG. 4 is an enlarged cross-sectional view of one of the tubular rails, taken along the line 4—4 in FIG. 3.

As can be seen from the bottom view of FIG. 2, the molded plastic track bed base 16 has a lattice-type pattern wherein the three lengthwise portions 22, 24, 26 of the lattice are directly below and touching the rails 4, 6, 8, and widthwise elements of the lattice define crossties 40 which are perpendicular to the three lengthwise sections 22, 24, 26. These crossties 40 are hollow and open on the bottom side but, except for the two crossties 40*a* and 40*b* closest to each end of a track section, are closed on all other sides. The top of each crosstie 40 has ridges and grooves to give the appearance of wooden railroad ties. The crossties 40*a* and 40*b* at each end have additional open portions to make allowance for the mechanical and electrical connecting features. As can be seen from FIG. 1, when the rails 4, 6, 8 are in place, the lengthwise portions 22, 24, 26 are not immediately apparent. Instead, the simulated crossties 40 of the molded base 16 are seen as the prominent feature of the base.

The track section connecting features comprise two separate, yet complementary, systems, one mechanical in nature and one primarily electrical in nature. The mechanical connection system is comprised of elements that are part of the molded plastic form of the base. As can be seen from FIGS. 2, 9, 10, 11, the crossties 40*a* and 40*b* and associated protruding and receiving connecting elements are situated such that a protruding U-shaped element 42 associated with the leftmost rail 4 extends and joins to a receiving slot element 44 associated with the rightmost rail 8 of the connecting track section. The U-shaped protruding element 42 is flexible enough to bend in slightly to fit into the corresponding shape of the receiving slot element 44 which consists mainly of two side walls 44*a*, 44*b* curving inward, that are not connected to each other. As a result, the U-shaped protruding element 42 snaps into the receiving slot element 44. Several features aid in the proper placement and secure fit of the two connecting elements. Protruding bumps 46 in the protruding, U-shaped element pop into corresponding grooves 48 of the receiving slot. The several side walls 50 of the two end crossties 40*a* and 40*b* are formed to provide additional structure and support for the protruding element 42. The side walls 44*a*, 44*b* help provide a secure fit and help prevent breakage of the protruding U-shaped element 42. An additional feature is an alignment ledge 52, with slightly raised edges 54*a*, 54*b*, located directly below the left rail 4 associated with the receiving slot element 44. This alignment ledge 52 aids in guiding the adjoining rail section. A recess 55 is defined at each end of the track assembly 2 in an upper surface of the base 16 directly under the associated rail 4 or 8. The associated rail 4 or 8 terminates in the same vertical pane as the rail and defines with the recess 55 a space for receiving the ledge 52 of a like track assembly. The recess 55 has side walls 55*a* and 55*b*. The distance between the side walls 55*a* and 55*b* of the recess 55 is just slightly greater than the width of the alignment ledge 52. The raised edges 54*a* and 54*b* of the alignment ledge extend upward along outer edges of the ends 18 and 20 of the rail. The distance between the raised edges 54*a* and 54*b* is just slightly greater than the width of the rail at the ends 18 and 20.

The primary element of the electrical connection system is a mainly rectangular, sheet metal connector 56. Now referring to FIGS. 2, 9, 10, 11 and 12, this connector 56 is located on the underside of the plastic track bed base 16 adjacent to a rail. Thus each end of a track section has three connectors 56, one for each rail, with a total of six of these identical connectors 56 per track assembly 2. Although mainly rectangular in appearance, the sheet metal is cut in several areas to accommodate features and functions of the connector 52. Two of the features provide the physical attachment to the track bed base 16 and the rails 4, 6, 8. Circular holes 58, 60 are cut into the connector to allow the connector 56 to snap down onto two cylinder-shaped projections 62, 64 which are part of the molded track bed base 16. Additionally, two side strips 66, 68 of the connector extend out from the main section of sheet metal and wrap up and around each section of track bed 16 and contact with the rails 4, 6, 8, thereby, not only providing attachment of the connector to the track bed base 16 but also creating and maintaining contact of the connectors 56 with the rails 4, 6, 8. A rectangular section 70 cut out from an area between these two attaching metal strips 66, 68 backs up against a plastic rectangular element 72 projecting out from the plastic molded base 16. This plastic projecting element 72 is a guide to align the connector 56 into the correct position and prevent lateral movement of the connector 56.

Other features of the connector 56 relate more to the connection of two opposing connectors 56 from adjoining track sections. From one side of a connector 56, two protruding strips of metal 74, 76 fold together to form a closed extension 78. Each of these extensions 78 extends into a complementary receiving area 80 of an adjoining connector 56. Near the two circular holes, a rectangular opening 82 is cut out to provide room for a plastic rectangular element 84 projecting out from the plastic molded base. This plastic protruding element 84 creates a divider between the protruding connector extension 78 and the connector receiving area 80. In conjunction with the dividers 84, flanges 86 and 88 along edges of the connector 56 extend up the crosstie walls 50 and provide a secure fit for the protruding connector extension 78 as the extension locks into the connector receiving area 80, with the extension being resiliently biased by its shape and material into engagement with the flange 86. The extension 78 is defined in part by the flange 88.

Figure 13:
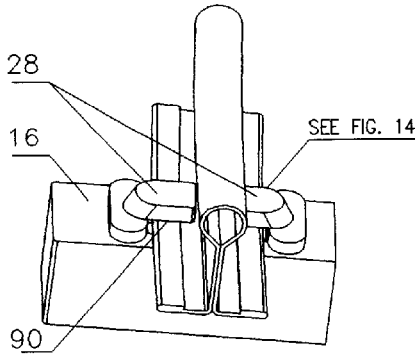
FIG. 13 is an enlarged perspective view of a portion of track section with the rail removed, showing rail brackets.
Figure 14:
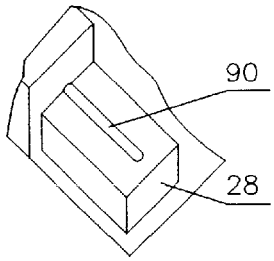
FIG. 14 is a further enlarged perspective view of the underside of one of the brackets, showing a ridge.

As can be seen from FIGS. 13 and 14, in order to hold the rails 4, 6, 8 more tightly and prevent lateral movement of the rails, brackets simulating rail spikes 28 are provided in some of the crossties 16. A ridge 90 on the underside of each bracket holds the rail down tightly against the tie.

Figure 15:
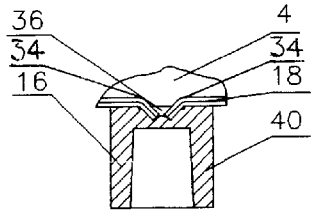
FIG. 15 is an enlarged cross-sectional view of a portion of track section, taken through a crosstie and showing the staking of one of the rails.

As can be appreciated from FIG. 15, small areas 34 of the laterally outward ends 18, 20 of each rail 4, 6, 8, which lie flat against the track bed, are staked into the molded track bed base 16, forming a hole 36. The force of the staking and the bendability of the sheet metal of the rails provides a secure attachment which then prevents lateral and lengthwise movement of the rails. For each track section, this staking is implemented at two points for each rail, for example, at the fourth crosstie from each end of a track section 2.

It will be apparent to those skilled in the art and it is contemplated that variations and/or changes in the embodiments illustrated and described herein may be made without departure from the present invention. Accordingly, it is intended that the foregoing description is illustrative only, no limiting, and that the true spirit and scope of the present invention will be determined by the appended claims.

We claim:

1. An electric model toy train track assembly, comprising:

a plurality of spaced, parallel electrically conducting hollow tubular rails;

a non-conducting base, said rails being fixed to said base;

a first connector providing a locking connection with a like track assembly; and a second connector distinct from said first connector, said second connector providing an electrically conducting connection with a like track assembly, whereby the track assembly is joinable with a like track assembly as well as with a conventional track assembly having pins extending from ends of rails.

2. The track assembly of claim 1, wherein each of said rails has at least one flange coplanar with and resting on said base, said flange having at least one portion extending into said base, whereby said rail is prevented from slipping relative to said base.

3. The track assembly of claim 1, wherein alignment formations extend up from said base on opposite sides of each rail and engage the rail in an area of engagement, each rail has a thickness in the area of engagement, and the alignment formations for each area of engagement are spaced from one another by a dimension substantially equal to the thickness of the rail in the area of engagement, whereby lateral movement of the rails is prevented.

4. The track assembly of claim 1, wherein the track assembly has opposite ends, and said first connector comprises a generally U-shaped resilient element protruding from each end of the track assembly.

5. The track assembly of claim 4, further comprising a receiving structure positioned at each end of the track assembly, the receiving structure being positioned, sized and shaped to mechanically interlock with the U-shaped resilient element of a like track assembly.

6. The track assembly of claim 5, wherein said receiving structure comprises two elements of resilient material extending from said base, said elements spaced from and curving toward one another to define sides of a receiving area for receiving the U-shaped element of a like track assembly.

7. The track assembly of claim 1, wherein the rails have opposite ends, and said second connector comprises an electrically conducting element extending longitudinally beyond one of the ends of one of the rails.

8. The track assembly of claim 7, further comprising a receiving portion positioned at each end of one of the rails, the receiving portion being positioned to engage the extending electrically conducting element of a like track assembly.

9. The track assembly of claim 8, wherein a non-conducting divider protrudes from said base to between said extending electrically conducting element and said receiving portion.

10. The track assembly of claim 7, further comprising a snap connection between said extending electrically conducting element and said base.

11. The track assembly of claim 1, wherein said first connector provides a locking connection with a like track assembly by movement of the track assembly in a first direction relative to a like track assembly, and said second connector provides an electrically conducting connection with a like track assembly by movement of the track assembly in said same first direction relative to a like track assembly, whereby a single direction movement of two of the track assemblies achieves the locking connection between the two track assemblies and the electrically conducting connection between the two track assemblies.

12. The track assembly of claim 1, further comprising an alignment element projecting from said track assembly, a recess spaced from said alignment element, said recess being dimensioned and positioned to receive the alignment element of a like track assembly.

13. The track assembly of claim 12, wherein said recess is adjacent to said first connector.

14. The track assembly of claim 1, wherein the first connector comprises one piece with the base.

15. An electric model toy train track assembly, comprising:

a plurality of spaced, parallel electrically conducting rails, each of the rails having two ends;

a non-conducting base, said rails being fixed to said base;

a first connector providing a locking connection with a like track assembly; and a second connector distinct from said first connector, said second connector providing an electrically conducting connection with a like track assembly and comprising two electrically conducting members extending longitudinally beyond one of the ends of one of the rails and diverging from one another, wherein the track assembly is joinable with a like track assembly as well as a conventional track assembly having pins extending from ends of rails.

16. The track assembly of claim 15, further comprising a receiving portion positioned at one of the ends of one of the rails, the receiving portion being positioned to engage the extending electrically conducting members of a like track assembly, the receiving portion comprising elements spaced apart from one another in a direction transverse to the length of the track section, at least portions of said diverging members being cammed by interaction with the receiving portion from positions in which said portions are in alignment with the elements of the receiving portion in a direction parallel to the length of the track section to positions in which said portions are out of alignment with the elements of the receiving portion in a direction parallel to the length of the track section.

17. An electric model toy train track assembly, comprising:

a plurality of spaced, parallel electrically conducting rails;

a non-conducting base, said rails being fixed to said base, each of said rails having at least one flange coplanar with and resting on said base, said flange having at least one portion extending into said base at an angle to the coplane of the flange and the base, whereby said rail is prevented from slipping relative to said base;

a first connector providing a locking connection with a like track assembly; and a second connector distinct from said first connector, said second connector providing an electrically conducting connection with a like track assembly.

18. An electric model toy train track assembly having opposite ends, comprising:

a plurality of spaced, parallel electrically conducting rails;

a non-conducting base, said rails being fixed to said base;

a first connector providing a locking connection with a like track assembly and comprising a generally U-shaped resilient element protruding from each end of the track assembly, the U-shaped element having first and second sides spaced apart from one another and a curved element extending between the sides; and a second connector distinct from said first connector, said second connector providing an electrically conducting connection with a like track assembly.

* * * * *